United States Patent [19]

Reed

[11] Patent Number: 4,861,178

[45] Date of Patent: Aug. 29, 1989

[54] VACUUM SYSTEM FOR COMPUTER PRINTERS

[76] Inventor: Patrick G. Reed, 187 Peary Cir., Cresson, Pa. 16630

[21] Appl. No.: 215,767

[22] Filed: Jul. 6, 1988

[51] Int. Cl.[4] ..... B41J 29/00

[52] U.S. Cl. ..... 400/719; 400/701; 400/691; 101/424.1; 346/25; 226/74

[58] Field of Search ..... 400/690, 690.1, 690.2, 400/690.3, 690.4, 691, 694, 679, 719, 701, 702, 702.1; 101/425, 424.1; 346/25; 226/74, 76, 80, 82, 95, 52, 200; 83/168

[56] References Cited

U.S. PATENT DOCUMENTS

| | | | |
|---|---|---|---|
| 3,098,332 | 7/1963 | Sutton | 51/270 |
| 3,259,288 | 7/1966 | Wassermann | 400/618 |
| 3,854,399 | 12/1974 | Keur et al. | 346/1.1 |
| 4,326,656 | 4/1982 | Gregory et al. | 226/59 |
| 4,388,009 | 6/1983 | Kumagai et al. | 400/719 |
| 4,514,936 | 5/1985 | Hurtado | 51/270 |

FOREIGN PATENT DOCUMENTS

| | | | |
|---|---|---|---|
| 22088 | 2/1982 | Japan | 400/719 |
| 90979 | 5/1983 | Japan | 400/196.1 |
| 167189 | 10/1983 | Japan | 101/426 |
| 152855 | 7/1987 | Japan | 400/719 |

OTHER PUBLICATIONS

Storage Technology Corp; Impact 5000 Series Theory Manual; Feb. 1987, pp. 3-15 to 3-17.

*Primary Examiner*—David A. Wiecking
*Attorney, Agent, or Firm*—Shlesinger & Myers

[57] ABSTRACT

For a computer printer having a paper feeder designed to engage a continuous perforated paper having a series of prepunched holes on the left and right marginal strips, a vacuum attachment is disclosed for keeping clean the interior of the computer printer from dust, paper perforations, paper punch waste materials, or other debris produced during printing operations, comprising vacuum means, nozzle means operably connected to said vacuum means, and means for amounting the nozzle means adjacent the paper feeder of the computer printer.

18 Claims, 3 Drawing Sheets

VACUUM SYSTEM FOR COMPUTER PRINTERS

FIELD OF THE INVENTION

The invention relates generally to vacuum devices and particularly to vacuum attachment and mechanisms for use in computer printers for keeping clean the interior of printers from dust, paper perforations, and other debris during printer operations.

BACKGROUND OF THE INVENTION

Computer printers break down for many reasons. One reason may be traced to accumulation of dust, paper perforations and other debris in the interior of the printer created during printer operations. The generation of the offending debris is often exacerbated by the continuous operation of the printers in most office environments, specially when high speed printers that generate several pages of report per minute and multiple carbon paper are used. The most common type of printers uses a tractor feeder mechanism to automatically advance the paper forward during printing operation. The papers used in these printers are continuous, fan folded paper blank having a series of prepunched holes along a strip portion on the left and right margins. These holes are adapted to engage the tractor feeder mechanism for advancing the paper forward. Additionally, the paper is provided with perforations on the left and right margins and across the width to separate the strip portions containing the prepunched holes and to define a standard page size. Each page could be conveniently separated from the continuous paper by tearing along the perforations across the width of the paper. The series of prepunched holes most often retain the waste materials generated by the hole puncher so that when the holes engage the tractor feeder, the waste materials are forced out and fall to the printer floor. Additionally, when a printed page is separated from the continuous paper blank by tearing along the perforations across the paper, dust is thereby generated. The generated debris, if left to accumulate inside the printer tends to work itself into the mechanical and electrical components of the printer. This then causes the printer to break down, resulting in valuable down time and lost productive manhours.

The invention is directed to collecting and disposing of dust, paper perforations, paper punch waste material and other debris before they become a problem for the computer printer.

OBJECTS OF THE INVENTION

It is therefor an object of the invention to provide a device for keeping clean the interior of a computer printer from dust, paper perforations, paper punch waste material and other debris created during printer operations.

It is another object of the invention to provide a vacuum attachment that could be conveniently installed in an existing computer printer already operating in an office.

It is yet another object of the invention to provide a vacuum mechanism that could be integrated into a computer printer by the printer manufacturer.

It is a further object of the invention to provide a vacuum device that will pick up and collect for later disposal dust, paper perforations, paper punch waste material and other debris generated inside a computer printer.

It is still another object of the invention to provide a vacuum device that would prevent unnecessary breakdown of computer printers caused by accumulation of dust, paper perforations or other debris.

It is another object of the invention to permit a computer printer to operate at a longer period of time between breakdowns.

It is a further object of the invention to keep the interior of a computer printer neat and clean from dust, paper perforations and other debris.

It is an additional object of the invention to cut down on the frequency of breakdown of a computer printer due to dust, paper perforations and other debris that accumulate inside the printer during operations.

It is still an object of the invention to provide a device that is cheap to manufacture.

In summary, the invention will keep clean the interior of a computer printer from dust, paper perforations, paper punch waste material and other debris generated during printer operations, resulting in less frequent breakdowns and increased productivity for the printer.

DESCRIPTION OF THE INVENTION

Figure 1:
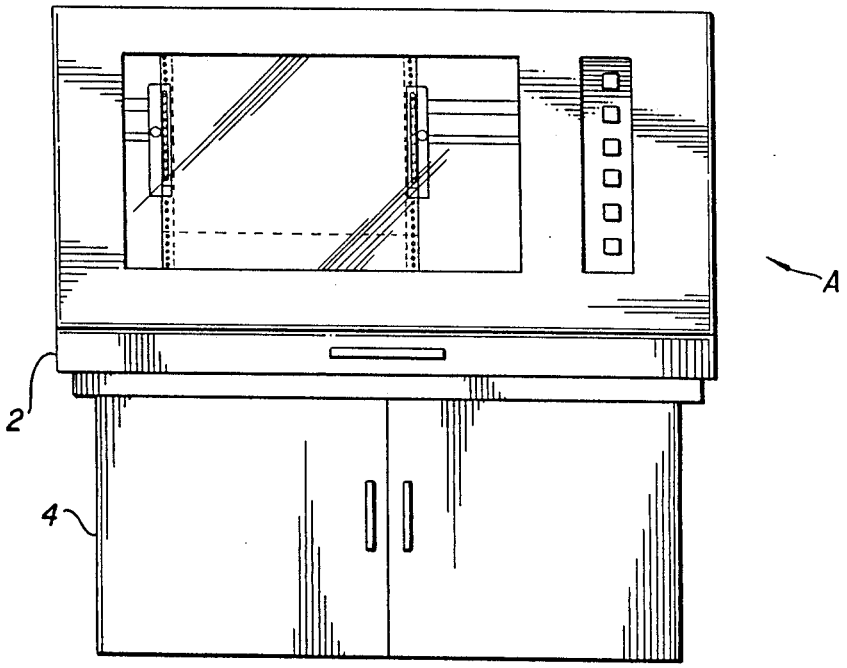
FIG. 1 is a front elevational view of a computer printer inside an enclosure.
Figure 2:
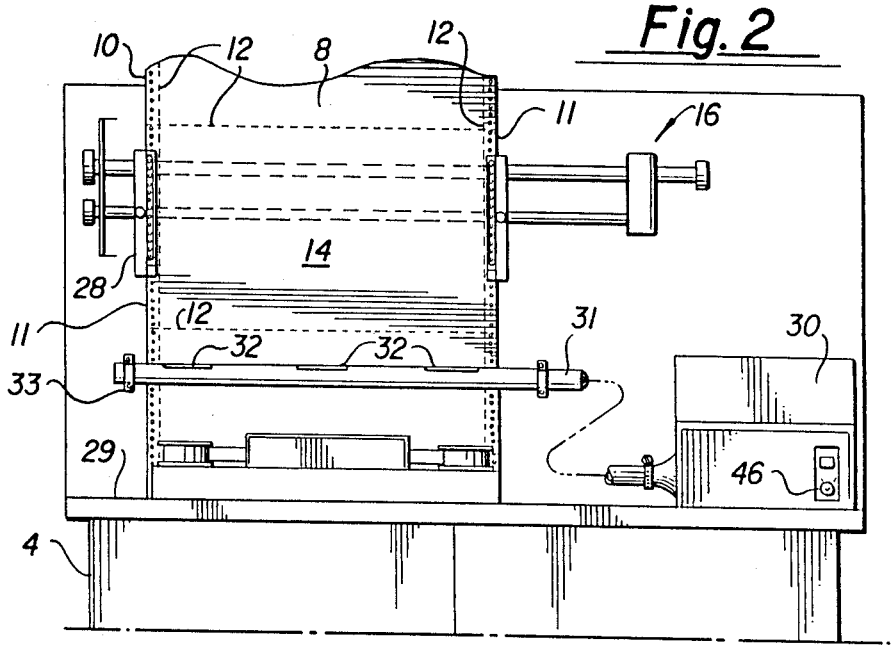
FIG. 2 is a front elevational view of the printer with the covers removed, showing the invention as installed therein.

A computer printer A which is a typical high-speed printer having an operable cover 2 and a base support 4 is shown in FIG. 1. A typical example of printer A is Printronix Printer (P573/88). The printer A utilizes a continuous paper blank 8 which includes a series of prepunched holes 10 extending along strip portions 11 on the left and right margins, as best shown in FIG. 2. Paper 8 also includes perforation lines 12 extending along the strip portions 11 and across its width. The perforation lines 12 define a page 14 so that as each page 14 is printed, an operator can conveniently separate the page 14 from the rest of the paper 8 by tearing along perforation lines 12 across the paper 8 and along the strip portions 11. Perforation lines 12 along the strip portions 11 provide for convenient separation from the page 14 and disposal of the strip portions 11 containing the prepunched holes 10.

Figure 5:
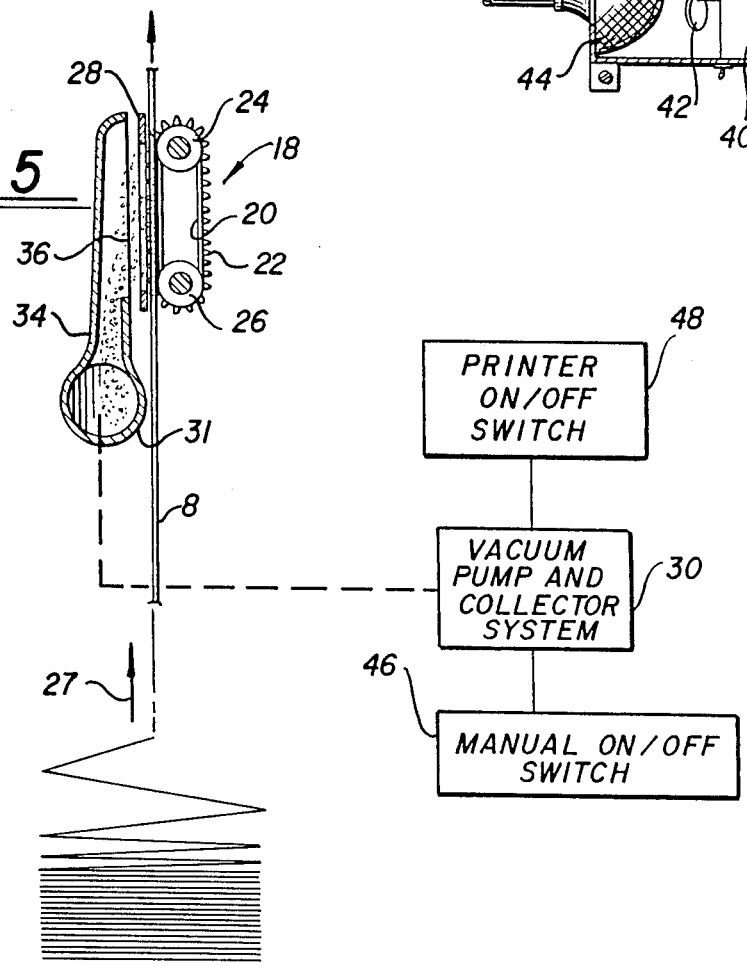
FIG. 5 is a schematic side elevational view of FIG. 4 showing the invention diagramatically connected to a block diagram for control thereof.

Printer A uses a paper feeder mechanism 16 which includes a tractor device 18, as best shown in FIG. 5. Other drive mechanisms such as sprockets, pressure rollers, etc., may be used to feed the paper. Tractor device 18 comprises an endless belt 20 having pins 22 disposed transversely along its outer side and spaced equidistantly along its length. Endless belt 20 wounds around a driving wheel 24 and an idler wheel 26. Prepunched holes 10 are adapted to engage pins 22 so that when driving wheel 24 causes the endless belt 20 to move, the paper 8 is caused to move in the direction indicated by arrow 27. Guides 28 keep the paper 8 engaged to the pins 22.

Printer A has horizontal plane surfaces typically designated by 29 situated below the paper feeder mechanism 16. Dust, paper perforations and other debris would tend to collect on plane surfaces 29.

Figure 3:
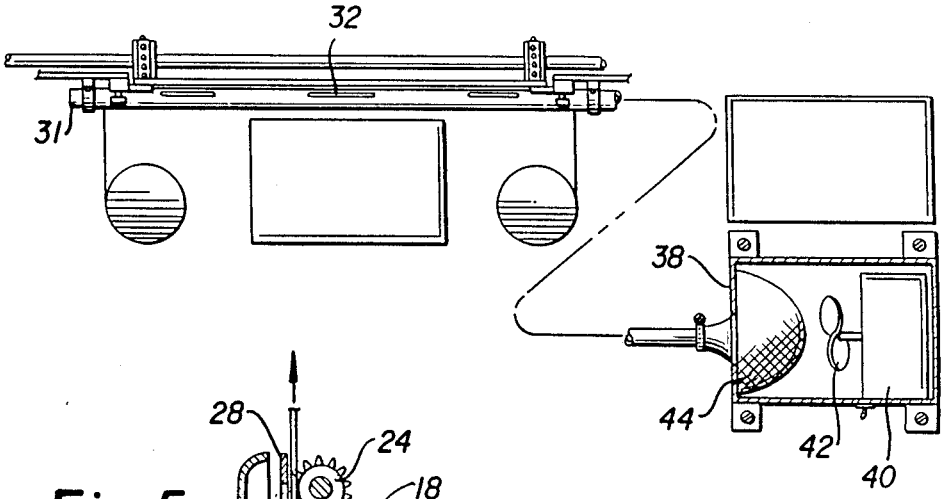
FIG. 3 is a top view of FIG. 2.

The invention comprises a vacuum unit 30 mounted inside the printer A, as best shown in FIG. 2. It should be clear to the person skilled in the art that mounting of the vacuum unit 30 could also be done outside the printer, if room does not permit mounting inside. Main nozzle 31 is operably connected to vacuum unit 30. Along the length of main nozzle 31 are a plurality of spaced slots 32, as best shown in FIG. 3. Main nozzle 31 is tubular and flexible so that it could be conveniently deformed to fit the available space inside the printer A. Suitable mounting means 33 support the main nozzle 31 adjacent to the paper 8 and below the tractor device 18.

Figure 4:
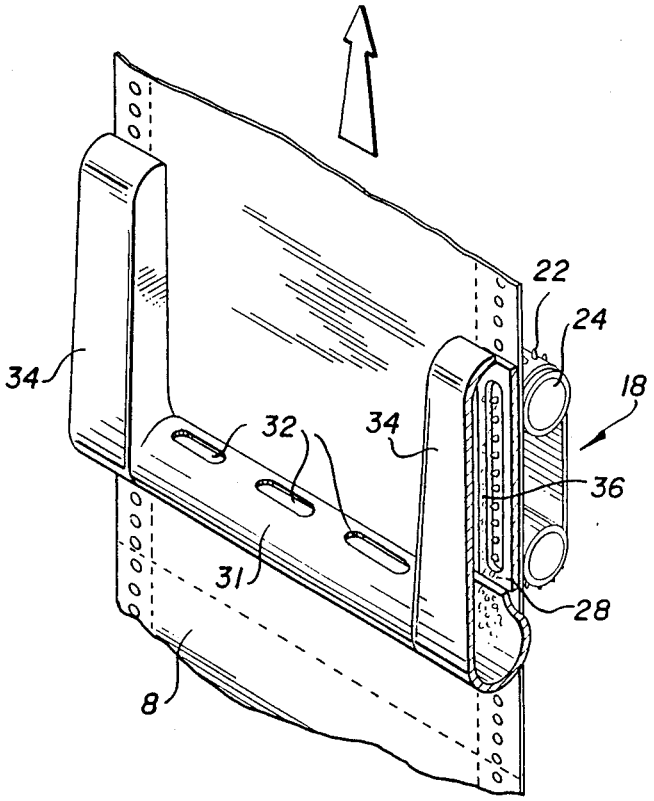
FIG. 4 is a fragmentary isometric view of another embodiment of the invention.

As another embodiment of the invention, there is shown in FIG. 4 to 5, branch nozzles 34 extending transversely from main nozzle 31. Branch nozzles 34 communicate with main nozzle 31 and present openings 36 adjacent to the tractor device 18. Mounting means 33 has enough gripping force to hold the branch nozzles 34 in operating position and yet has enough play to enable the main nozzle 31 to swivel about the mounting means 33 so that branch nozzles 34 could swing away from the guides 28. Space in front of the guides 28 would be needed when changing or adjusting paper 8 on the tractor device 18.

Vacuum unit 30 includes a housing 38, a motor 40 drivingly connected to a fan 42 for creating suction inside a vacuum bag 44. The housing 38 includes means (not shown) for convenient replacement of the vacuum bag 44.

Main nozzle 31 would preferrably be installed adjacent surfaces 29 on which dust, paper perforation, paper punch waste materials and other debris would tend to accumulate. The branch nozzles 34 are intended to collect the paper punch waste materials as they are released by pins 22 of the tractor device 18. Any debris that escapes from branch nozzles 34 is collected by main nozzle 31 by means of slots 32.

The vacuum unit 28 is controlled by a manual on/off switch 46. The vacuum unit 28 could also be controlled from the printer on/off switch 48 so that when the printer A is on, the vacuum unit 30 is also on.

Although the invention is described for a high-speed printer as exemplified by Printronix Printer (P573/88), the invention is equally adaptable to other types of computer printers such as those typically driven by personal computers and to other computer equipment such as main frames and personal computers.

OPERATION

When the printer A is turned on for operation, the vacuum unit 30 is also turned on either manually through the manual on/off switch 46 or by means of the printer on/off switch 48 if the vacuum unit 30 is wired to the printer on/off switch 48, as best shown in FIG. 4. As soon as the vacuum unit 30 is operating, suction is generated in the main nozzle 31 and branch nozzles 34. Air is pulled into openings 36 and slots 32. As the tractor feeder mechanism 16 advances the paper 8 during printer operation, paper punch waste materials left in the prepunched holes 10 are pushed out as the holes 10 engage the pins 22 in the tractor device 18. The waste materials drop out and are collected through the openings 36 of the branch nozzles 34 or through the slots 32 of the main nozzle 31. When page 14 is separated from the paper 8, paper dust is generated from the perforation lines 12. The dust is either sucked into openings 36 of the branch nozzles 34 or the slots 32 of the main nozzle 31. The paper punch waste materials and dust are collected by vacuum bag 44. When bag 44 fills up, it is easily replaced with an empty bag.

Thus it is seen that dust, paper perforations and other debris generated during printer operation are collected and later disposed of before they could cause a breakdown of printer A.

Although the invention has been described around a specific computer printer, it could equally be used in any type of printer. The location of vacuum unit 30 or the main nozzle 31 and the branch nozzles 34 may be modified to suit the specific printer. The main nozzle 31 and the branch nozzles 34 may have to be adapted to fit the room available in the printer.

While this invention has been described as having preferred design, it is understood that it is capable of further modification, uses and/or adaptations of the invention following in general the principle of the invention and including such departures from the present disclosure as some within known or customary practice in the art to which the invention pertains, and as may be applied to the essential features set forth, and fall within the scope of the invention or the limits of the appended claims.

I claim:

1. A printing apparatus, comprising:

(a) a computer printer for printing on a continuous perforated paper;

(b) an enclosure for said printer;

(c) said computer printer including a paper feeder having means for engaging a continuous, perforated paper having a series of pre-punched holes on the left and right marginal strips thereof;

(d) means for generating a vacuum;

(e) nozzle means, operably connected to said vacuum means, for directing said vacuum for collecting debris generated during printing operations;

(f) means for mounting said nozzle means adjacent said paper feeder; and (g) said nozzle means including a tube, being disposed below said engaging means within said enclosure and adjacent the face and across the entire width of the paper.

2. A printing apparatus, as in claim 1, wherein:

(a) said vacuum means is mounted inside the printer.

3. A printing apparatus, as in claim 1, wherein:

(a) said vacuum means is mounted adjacent the printer.

4. A printing apparatus, as in claim 1, wherein:

(a) said tube includes at least two spaced slots adjacent left and right margins of the paper.

5. A printing apparatus, as in claim 4, wherein:

(a) said nozzle means is mounted adjacent to horizontal plane surfaces below the paper feeder so that debris released by the paper feeder settling on the plane surfaces is collected by said nozzle means.

6. A printing apparatus, as in claim 1, wherein:

(a) said nozzle means includes at least a branch nozzle extending from said tube and communicating therewith; and (b) said branch nozzle includes an opening disposed adjacent the paper feeder.

7. A printing apparatus, as in claim 6, wherein:

(a) said mounting means includes means for rotatably moving said branch nozzles away from the paper feeder.

8. A printing apparatus, as in claim 1, wherein:

(a) said vacuum means includes a replaceable vacuum bag, fan and drive means; and (b) said fan is operably connected to said drive means for creating a suction inside said vacuum bag.

9. A printing apparatus, as in claim 1, wherein:

(a) said tube is flexible.

10. A vacuum attachment for keeping clean the interior of a computer printer from dust, paper perforations, paper punch waste materials, or other debris produced during printing operations, said computer printer having a paper feeder designed to engage a continuous perforated paper having a series of pre-punched holes on the left and right margin strips thereof, said vacuum attachment comprising:

(a) means for generating a vacuum;

(b) nozzle means operably connected to said vacuum means for directing said vacuum for collecting debris generated during printing operations;

(c) means for mounting said nozzle means adjacent a paper feeder of a computer printer; and (d) said nozzle means including a tube, being disposed below the paper feeder within the printer, and adjacent the face and across the entire width of the paper.

11. A vacuum attachment, as in claim 10, wherein:

(a) said vacuum means is mounted inside the printer.

12. A vacuum attachment, as in claim 10, wherein:

(a) said vacuum means is mounted adjacent the printer.

13. A vacuum attachment, as in claim 10, wherein:

(a) said tube includes at least two spaced slots adjacent left and right margins of the paper.

14. A vacuum attachment, as in claim 13, wherein:

(a) said nozzle means is mounted adjacent to horizontal plane surfaces below the paper feeder so that debris released by the paper feeder settling on the plane surfaces is collected by said nozzle means.

15. A vacuum attachment, as in claim 10, wherein:

(a) said nozzle means includes at least a branch nozzle extending from said tube and communicating therewith; and (b) said branch nozzle includes an opening in fluid communication with said tube and disposed adjacent the paper feeder.

16. A vacuum attachment, as in claim 15, wherein:

(a) said mounting means includes means for rotatably moving said branch nozzles away from the paper feeder.

17. A vacuum attachment, as in claim 10, wherein:

(a) said vacuum means includes a replaceable vacuum bag, fan and drive means; and (b) said fan is operably connected to said drive means for creating a suction inside said vacuum bag.

18. A vacuum attachment, as in claim 10, wherein:

(a) said tube is flexible.

* * * * *